US007670278B2

(12) United States Patent
Westerkull

(10) Patent No.: US 7,670,278 B2
(45) Date of Patent: Mar. 2, 2010

(54) HEARING AID SYSTEM

(75) Inventor: Patrik Westerkull, Hovas (SE)

(73) Assignee: Oticon A/S, Smorum (DK)

( * ) Notice: Subject to any disclaimer, the term of this patent is extended or adjusted under 35 U.S.C. 154(b) by 584 days.

(21) Appl. No.: 11/306,555

(22) Filed: Jan. 2, 2006

(65) Prior Publication Data

US 2007/0156011 A1 Jul. 5, 2007

(51) Int. Cl.
*H04R 25/00* (2006.01)

(52) U.S. Cl. ..... 600/25

(58) Field of Classification Search ..... 600/23–25; 128/897, 899; 607/57, 137; 381/312, 323, 381/356, 151
See application file for complete search history.

(56) References Cited

U.S. PATENT DOCUMENTS 4,612,915 A * 9/1986 Hough et al. ..... 600/25
5,015,224 A 5/1991 Maniglia
2001/0031996 A1* 10/2001 Leysieffer ..... 607/57
2002/0038072 A1 3/2002 Muller et al.
2002/0196956 A1* 12/2002 Andersen et al. ..... 381/323
2006/0015155 A1 1/2006 Charvin et al.

* cited by examiner

*Primary Examiner*—Charles A Marmor, II
*Assistant Examiner*—Christine D Hopkins
(74) *Attorney, Agent, or Firm*—Birch, Stewart, Kolasch & Birch, LLP

(57) ABSTRACT

A direct bone conduction hearing aid system for generating direct bone conduction vibration includes a vibrator that is placed in an implanted vibrator unit and an implanted energy-receiving unit that has an energy-receiving inductive coil. A vibrator supply cable connects the implanted energy-receiving unit to the implanted vibrator unit. A mounting arm connects the implanted vibrator unit with an anchoring fixture that is anchored to the skull bone through the skull bone surface. The implanted vibrator unit is positioned in the mastoid cavity. The mounting arm is positioned laterally to the implanted vibrator unit and the bone fixation portion of the anchoring fixture.

17 Claims, 3 Drawing Sheets

HEARING AID SYSTEM

TECHNICAL FIELD

The present invention relates to a hearing aid system for providing direct bone conduction hearing.

BACKGROUND OF THE INVENTION

Bone conduction is the principle of transmitting vibrations via the skull bone to the inner ear, i.e., the cochlea. For a bone conduction hearing aid the vibrations are transmitted through the skull bone, and since the cochlea is a winding in the bone, the vibrations go directly to the cochlea. This means that for bone conduction the normal transmission chain with the ossicular bones, for example the stapes, is not directly involved in the transmission of the vibrations to the cochlea. Hearing aids that for example connect to the middle ear ossicular bones are not bone conduction hearing aids.

A direct bone conduction hearing aid is a type of bone conduction hearing aid where the vibrator of the hearing aid is firmly connected to the skull bone so that the vibrations from the vibrator do not have to go through the skin to reach the skull bone. A traditional bone conductor where the vibrations have to go through the skin to reach the skull bone is less efficient than a direct bone conductor since the vibrations will be damped when going through the skin.

The most common type of direct bone conductors consist of an external hearing aid with a vibrator that is connected to a skin-penetrating abutment that is connected to a screw-shaped fixture anchored in the skull bone. These patients have often problems with skin infections due to the permanent skin-penetrating abutment.

Direct bone conductors with the vibrator implanted under the skin has been suggested in for example U.S. Pat. No. 3,209,081, US2004032962 and in Hearing by Bone Conduction, Stefan Stenfelt, Chalmers University of Technology, 1999. These solutions have however several drawbacks.

The design suggested by Stenfelt has a vibrator unit positioned in the mastoid cavity and the anchoring fixture is anchored deep in the bottom of the mastoid cavity. The problem with this anchoring is that the bone in this area is very soft, so the anchoring will be quite weak. If the anchoring fixture is placed deep in the mastoid cavity, it will also be difficult to get access to the anchoring fixture if the vibrator unit needs to be removed.

In the solution suggested in US2004032962, the vibrator is placed on the outside of the skull bone and the implantable arrangement is contained in one unit. Since it is very difficult to do a very flat vibrator, the aesthetics of this solution will not be very good. To do the whole implantable arrangement in one unit is also not a good solution since the vibrator, which is usually an electromagnetic vibrator, should not be placed together with the inductive energy transmission coil since it may interfere with the function of the inductive energy transmission.

SUMMARY OF THE INVENTION

The present invention provides an effective solution to the above-outlined problems with implantable direct bone conduction hearing aids. More particularly, the direct bone conduction hearing aid system of the present invention has a vibrator that is placed in an implanted vibrator unit. The implanted vibrator unit is positioned in the mastoid cavity. A mounting arm extends from the lateral end of the implanted vibrator unit to a lateral side (i.e., the outside) of the skull bone over part of the skull bone surface where the mounting arm is fixated to the skull bone via an anchoring fixture. The anchoring fixture is easy to mount and access since it is mounted to the skull bone from a lateral position. The anchoring fixture is preferably a screw-shaped osseointegrating fixture that is screwed into the skull through the skull bone surface.

In this way the vibrator that needs some space is located in the mastoid cavity where there is room for it. However, via the mounting arm, the vibrator is fixated to the cortical skull bone that has a high bone quality and where the anchoring fixture is easy to mount and access.

The present invention has a microphone system that picks up audio sound and converts it into an electrical microphone signal. The microphone or microphone system of the hearing aid system may be either implanted, placed in an external transmitter unit, placed in an external battery unit or placed in a separate external microphone unit. A preamplifier with the audio signal processing is usually placed together with the microphone. The signal from the microphone may be transmitted to the implanted electronics either through the inductive energy link or a separate transmission link. An FM or AM link could for example be used for this transmission.

The present invention also has an amplifier that amplifies the electrical microphone signal and drives a vibrator that generates audio vibrations. This amplifier is an output amplifier.

The implanted vibrator unit that has a housing and the vibrator is fixated to the housing. The mounting arm is preferably fixated at a lateral end of the housing of the implanted vibrator unit.

The anchoring fixture has a bone fixation portion that is anchored in the skull bone through a lateral skull bone surface.

The vibrator is mechanically connected to the skull bone via the housing of the implanted vibrator unit, the mounting arm and the anchoring fixture.

The audio vibrations from the vibrator go through the mounting arm and the anchoring fixture to the skull bone;

The present invention has an implanted energy-receiving unit with an energy-receiving inductive coil that picks up electromagnetic energy and converts it into an electric supply voltage and current. The energy from the electric supply voltage and current is used to supply the amplifier, either directly or the energy may be stored in for example a battery or capacitor before it is used. A vibrator supply cable connects the implanted energy-receiving unit to the implanted vibrator unit;

For the present invention the implanted vibrator unit is separate from the implanted energy-receiving unit. This is very important since the ferromagnetic material that is often used in a vibrator may severely affect the function of the inductive link between an external device and the energy-receiving inductive coil. The vibrator usually works at audio frequencies whereas the inductive link often works at for example 0.5 MHz. The vibrator may also affect the permanent magnet arrangement that is often used to hold an external transmitter unit in place against the skin over the energy-receiving inductive coil.

The electronics that is required in the implanted arrangement may be placed either in the implanted energy-receiving unit, in the implanted vibrator unit or in a separate unit on the cable that goes from the implanted energy-receiving unit to the implanted vibrator unit. The implanted electronics includes the amplifier that drives the vibrator.

The present invention offers a unique solution for a safe, aesthetic and reliable implantable direct bone conduction hearing aid system.

The vibrator may be any type of vibrator, for example a piezoelectric vibrator, however a preferred solution is an electromagnetic vibrator.

Most electromagnetic vibrators for direct bone conductors has one portion that oscillates in relation to the skull bone and one portion that is mechanical fixed in relation to the skull bone. In existing solutions the coil is mounted in the portion of the vibrator that oscillates in relation to the skull bone. This solution may be a compact and space saving solution also for the present invention. The supply cables that go through the housing of the vibrator unit will in this case be flexible when going over to the coil since the coil is moving with the vibrations in relation to the housing of the vibrator unit. Such flexible lead can be done with for example litz wires or etched flex film.

In a preferred embodiment of the present invention, the vibrator unit is however designed so that the vibrator coil is mechanically fixed in relation to the housing of the vibrator unit. The other portion of the vibrator, where the coil is not placed, is the portion that oscillates in relation to the skull bone. In this way the wires that go through the housing of the vibrator unit to the coil do not need to be flexible and there will be no wear and tear on these cables. In this solution extra mass may be required on the oscillating portion to make sure that the vibrator has the right frequency characteristics.

In a preferred embodiment, the hearing aid system has an implanted battery. In this case the external transmitter unit is only needed when charging the battery. The battery may be placed in the implanted energy-receiving unit or in a separate implanted battery unit that is connected with a cable to the implanted energy-receiving unit. This is an efficient solutions for patients who are significantly worried about the aesthetics and who want nothing or as little as possible of the device to be visible.

In a preferred embodiment, the hearing aid system of the present invention has an external transmitter unit with a battery and an energy transmitting inductive coil that continuously transmits energy to the implanted energy-receiving unit. The external transmitter unit may be connected to the implanted energy-receiving unit with a magnetic attachment. This is an efficient solution for patients who do not need a lot of power from the hearing aid and who do not want to have an implantable battery.

In a preferred embodiment, the hearing aid system of the present invention has an external transmitter unit, an external battery unit and a cable that connects the external transmitter unit and the external battery unit. The external unit has an energy transmitting inductive coil that continuously transmits energy to the implanted energy-receiving unit. The external battery unit may be a body worn unit or a unit designed as an ear hook that can be worn as a behind the ear hearing aid. This is the best solution for patients who need a powerful device where the battery lasts longer.

Even if the battery is implanted it might be necessary, especially for powerful versions of the hearing aid system, to place the microphone in an external microphone unit to minimize the risk for acoustic feedback and it will in this case also be easier to upgrade the preamplifier.

If the battery is placed in the external transmitter unit or in an external battery unit it would be most efficient to place the microphone in either the external transmitter unit or in the external battery unit.

In a preferred embodiment, the implanted energy-receiving unit has holes for receiving a fixation screw that can be fixated to the skull bone. The traditional way of anchoring an implantable unit like this is to suture it to the skull bone. This procedure is however a quite time consuming part of the surgical procedure. A solution where the fixation is done with fixation screws will make the surgical procedure quicker and simpler. This fixation will also be more safe and stable since this anchoring screw can be done with an osseo-integrating function. The fixation screw may go either directly through the hole in the implanted energy-receiving unit into the skull bone or it may be a design where the fixation screw in the bone has a threaded inner hole to receive a connection screw that goes through the hole in the implanted energy-receiving unit. It is of course possible to have more than one hole and more than one fixation screw. Probably two holes and two fixation screws is the ideal to get a stable fixation without too many screws.

In a preferred embodiment, the vibrator supply cable has a connector so that the implanted energy-receiving unit can be disconnected from the implanted vibrator unit. In this way it is possible to change one of the implanted vibrator unit or the implanted energy-receiving unit without having to change the other unit.

In a preferred embodiment, the anchoring fixture has a threaded inner hole to receive a connection screw that fixates the mounting arm to the anchoring fixture. In this way there is no initial pressure from the mounting arm against the skull bone and it is easy to change the vibrator unit without having to remove the anchoring fixture from the bone.

In a preferred embodiment, the implanted electronics includes an energy storing capacitor with a capacitance greater than 1 mF. With a significant capacitive storage in the implanted electronics, it is possible to reduce the maximum energy that needs to be transmitted through the skin from the external transmitter unit to the implanted energy-receiving unit. When the vibrator needs only smaller amount of energy, the capacitor is charged, and then when the vibrator needs more energy, energy may be taken from the capacitor. This is a unique solution that makes it possible to keep a high efficiency of the inductive wireless energy transmission through the skin if the battery is placed externally. In case the battery is implanted this capacitor will increase the maximum available power for the vibrator, since an implantable battery may be limited in term of how much current it can deliver instantly. A capacitor value of 1 mF is the significant minimum value to get an efficient energy storage function for a direct bone conduction application.

In a preferred embodiment of the hearing aid system the implanted vibrator unit, the mounting arm and the anchoring fixture is made in one unit. In this way the mounting of the implanted vibrator unit can be easier during surgery. Either the implanted vibrator unit, the mounting arm and the anchoring fixture is made in one integrated unit so that they can not be taken apart easily, or they can be delivered as a pre mounted assembly that is easy to install but can still be separated if necessary. In this embodiment it is not possible to screw the anchoring fixture into the bone so the anchoring fixture may for example have a conical shape so that it can be pressed into a hole in the bone to get an initial stability.

In a preferred embodiment of the present invention the microphone system includes two microphones and a programmable microphone processing circuit where the sensitivity for sound coming from the front compared to sound coming from the rear is variable by programming the circuit digitally in a programmable circuit. This type of microphone system may also be based on more than two microphones, but usually two microphones are sufficient for a good function. Due to-the poor hearing of these patients, it is critical that they can pick up as much as possible of the speech information from a person talking to them when there is for example noise coming from behind. By using directional microphones sound can be picked up more from a specific direction.

In a preferred embodiment the hearing aid system has a programmable circuit for digitally programming the sound processing parameters of the amplifier. In this way the hearing aid can be programmed individually for each patient or for example programmed to work well in different listening environments.

In a preferred embodiment of the present invention, the hearing aid system has a digital feedback suppression circuit. The feedback suppression circuit reduces the output of the vibrator at those frequencies where feedback is most likely to occur and it is then possible to have an overall higher gain in the present invention. The feedback suppression circuit is usually part of the pre amplifier circuitry or may be separate and may then be called a feedback cancellation circuit.

In a preferred embodiment of the present invention, an electromagnetic AM signal is sent from the energy-transmitting coil to the energy-receiving coil. The AM signal includes sound information from the microphone. The AM signal is used for two purposes in the implantable unit: 1) the AM signal is rectified into a DC supply and 2) the AM signal is decoded. The decoded AM signal then goes into an amplifier that is supplied by the DC supply. This is an efficient solution for patients where there is no significant problem with electromagnetic interference from other equipment.

In a preferred embodiment of the present invention, an electromagnetic energy signal is sent from the energy-transmitting coil to the energy-receiving coil. The electromagnetic energy signal that is picked up by the energy-receiving coil is rectified into a DC supply that supplies a driver amplifier that drives the vibrator. An electromagnetic FM signal is transmitted from the external unit to an implanted FM receiver that decodes the FM signal into a decoded signal. This decoded signal goes into the vibrator driver amplifier where it is amplified to drive the vibrator. This solution may have lower efficiency due to the power consumption of for example the FM receiver. It is however a good solution for patients in environments where there may be problems with electromagnetic interference from other equipment.

In a preferred procedure, the present invention involves a surgical procedure where the implantable vibrator unit is positioned in the mastoid cavity. The anchoring fixture is fixated into the skull bone through the skull bone surface from a lateral direction. The implanted vibrator unit is then anchored to the skull bone with a mounting arm that extends from the implanted vibrator unit to the anchoring fixture. The procedure also includes positioning an implanted energy-receiving unit beside the implanted vibrator unit, the anchoring fixture and the mounting arm.

DETAILED DESCRIPTION

Figure 1:
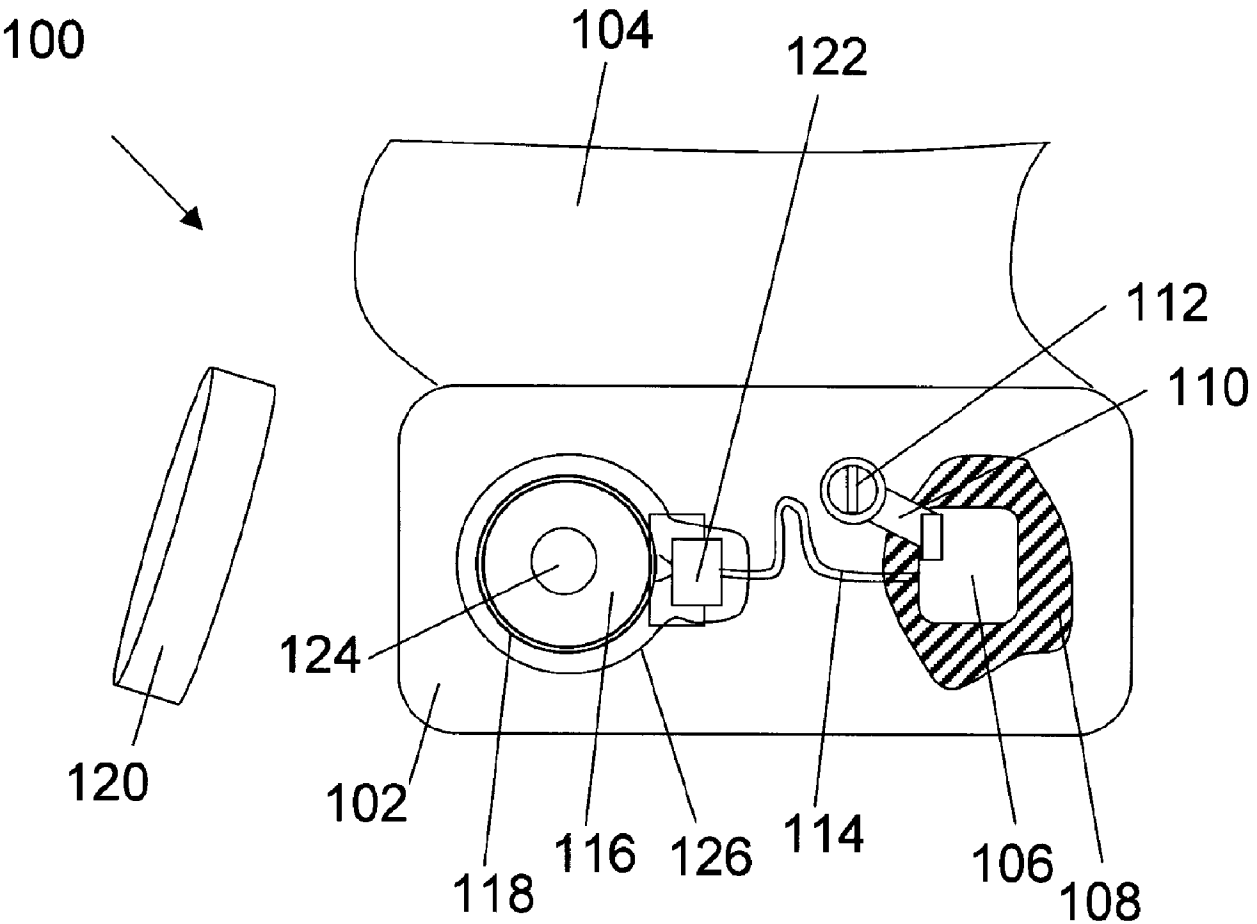
FIG. 1 is a side view of a skull with the implantable and external arrangement of the hearing aid system of the present invention.

FIG. 1 is a side view of the hearing aid system 100 of the present invention. A skull bone 102 is visible since a skin flap 104 has been folded away for the surgery. An implanted vibrator unit 106 is mounted in a mastoid cavity 108. A mounting arm 110 extends from the implanted vibrator unit 106 to an anchoring fixture 112. The anchoring fixture 112 is mounted through a hole (not seen) in the mounting arm 110. The anchoring fixture 112 is screwed into the skull bone 102 from a lateral direction, i.e., from the side of the skull. A vibrator supply cable 114 goes from the implanted vibrator unit to an implanted energy-receiving unit 116. The implanted energy-receiving unit 116 has an energy-receiving inductive coil 118 that can receive electromagnetic power by wireless induction from an external transmitter unit 120. The implanted electronics 122 is placed in the implanted energy-receiving unit 116. The implanted energy-receiving unit 116 has a magnetic portion 124 so that the external transmitter unit 120 can be attached magnetically to the implanted energy-receiving unit 116. Before the external transmitter unit 120 is attached and used, it is of course necessary to suture the skin flap 104 back over the implanted components and let the soft tissue heal. The implanted energy-receiving unit 116 is enclosed by a silicone protection 126. The implanted electronics 122 can pick up the signal from a microphone (not seen) in the external transmitter unit 120. The implanted electronics 122 is powered from the implanted energy-receiving unit 116. The implanted electronics 122 amplifies the signal and drives the implanted vibrator unit 106. The vibrations from the implanted vibrator unit are transmitted to the skull bone via the mounting arm 110 and the anchoring fixture 112.

Figure 2:
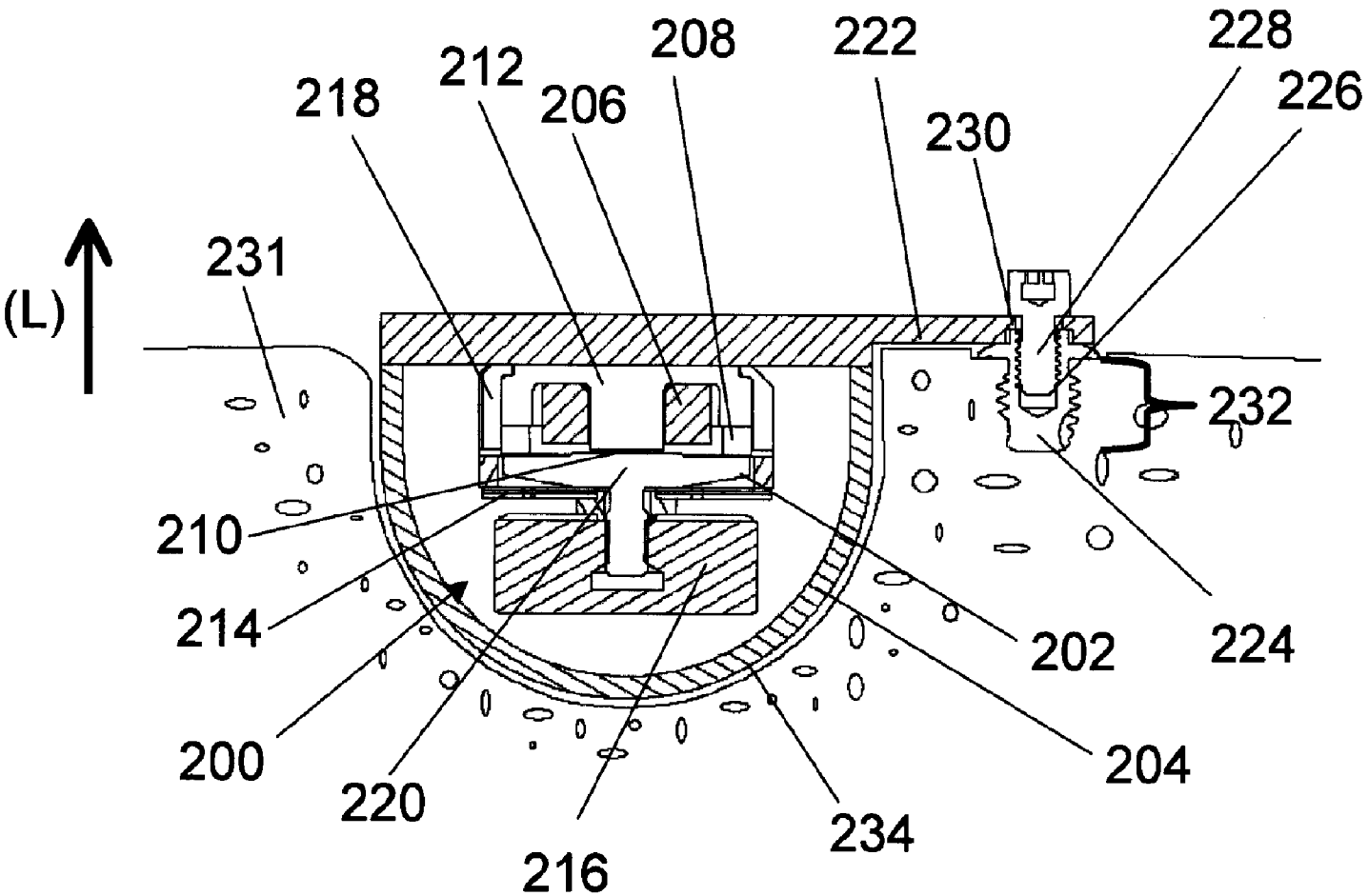
FIG. 2 is a cross-sectional top view of an implanted vibrator unit, the mounting arm and the anchoring fixture mounted in the mastoid cavity.

FIG. 2 is a cross-sectional top view of an implanted vibrator unit 200. A vibrator 202 is enclosed by a hermetic housing 204. The vibrator 202 has a coil 206, a magnet 208, an air gap 210, a bobbin 212, a spring 214, a vibration mass 216, a bobbin frame 218 and a vibrator plate 220. The coil 206, the magnet 208, the bobbin frame 218 and the bobbin 212 are connected together and they are fixed in relation to the housing 204. The vibration mass 216 and the vibrator plate 220 are connected together and they can oscillate in relation to the housing 204 to generate vibrations. The spring 214 connects the vibrator plate 220 with the bobbin frame 218. A mounting arm 222 connects the housing 204 of the implanted vibrator unit 200 with an anchoring fixture 224. The anchoring fixture 224 has a threaded inner hole 226 to receive a connection screw 228. The connection screw 228 goes through a hole 230 in the mounting arm 222 to connect the mounting arm 222 to the anchoring fixture 224. The arrow (L) indicates the lateral direction. The anchoring fixture 224 is screwed into the skull bone 231 from the lateral direction (L). The lateral direction points away from the head of the patient. The anchoring fixture 224 has a fixation portion 232 that is osseointegrated to the skull bone 231. The implanted vibrator unit 200 is positioned in the mastoid cavity 234.

Figure 3:
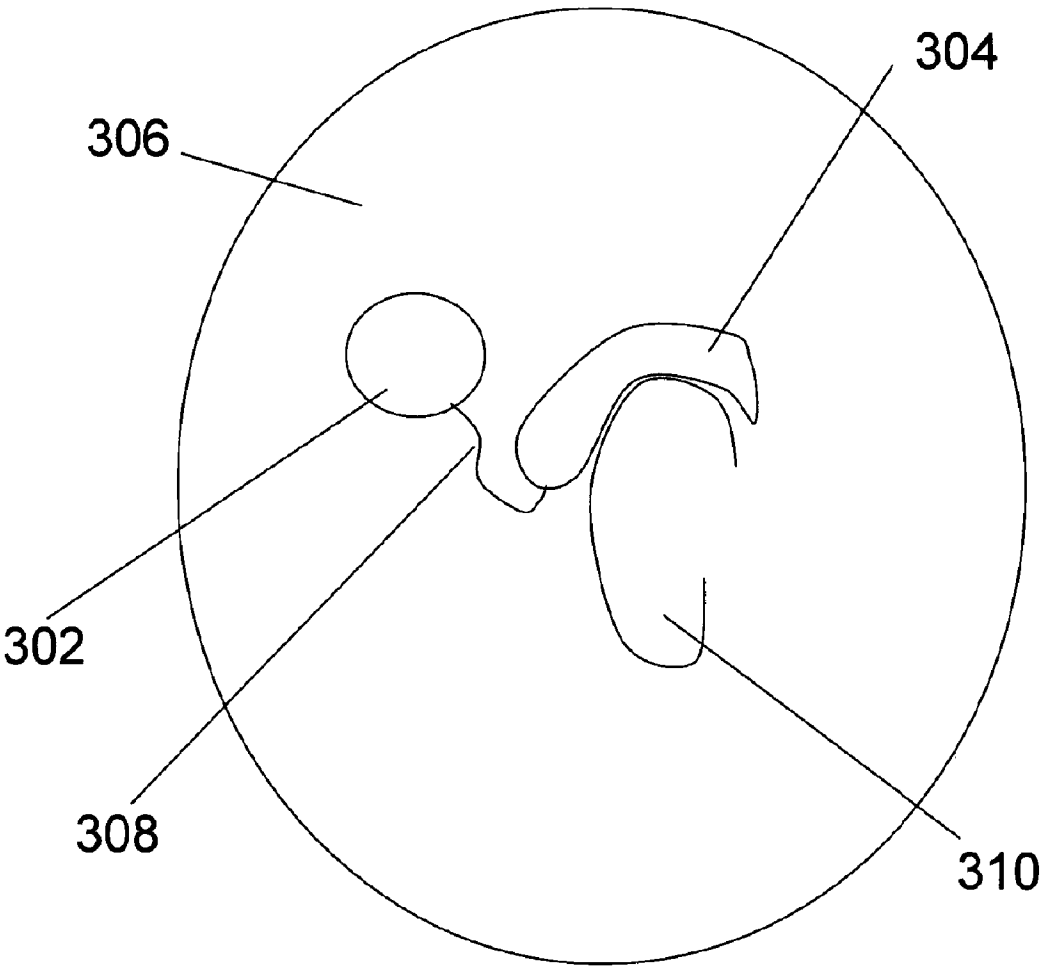
FIG. 3 is side view of an external transmitter unit and an external battery unit worn on the head of a patient.

FIG. 3 is side view of an external transmitter unit 302 and an external battery unit 304 worn on the head 306 of a patient. The external transmitter unit 302 is fixated to the head 306 with a magnetic attachment to an implanted energy-receiving unit (not seen). The external transmitter unit 302 is powered by the external battery unit 304 via a cable 308. The external battery unit 304 is worn on the outer ear 310.

For all of the above embodiments several alternative designs and combinations are possible and the invention is not limited to the preferred embodiments presented above. While the present invention has been described in accordance with preferred compositions and embodiments, it is to be understood that certain substitutions and alterations may be made thereto without departing from the spirit and scope of the following claims.

What is claimed is:

1. A direct bone conduction hearing aid system, comprising:

a microphone system which can pick up audio sound and generate electrical microphone signals therefrom;

a vibrator unit for positioning in a mastoid cavity, said vibrator unit including a housing and a vibrator attached to a wall of the housing;

an amplifier for receiving and amplifying said electrical microphone signals and driving said vibrator;

an anchoring fixture for attachment to a skull bone covered by skin, through a lateral skull bone surface, said anchoring fixture including a fixation portion;

a mounting arm attached to said wall of said housing and extending in a direction substantially parallel to said wall to said anchoring fixture, said mounting arm conveying vibrations from the vibrator and the vibrator housing to the anchoring fixture;

an energy-receiving unit which includes an energy-receiving inductive coil that can pick up electromagnetic energy and provide an electrical supply current and voltage for the amplifier; and a vibrator supply cable which extends from the energy-receiving unit to the vibrator unit.

2. The hearing aid system according to claim 1, wherein the vibrator is an electromagnetic vibrator having a coil which is mechanically fixed in relation to the housing.

3. The hearing aid system according to claim 1, including an implantable battery.

4. The hearing aid system according to claim 1, comprising:

an external transmitter unit;

a battery in the external transmitter unit;

the microphone system being located in the external transmitter unit; and the external transmitter unit having an energy-transmitting inductive coil that transmits energy to the energy-receiving unit.

5. The hearing aid system according to claim 1, comprising:

an external transmitter unit;

an external battery unit; and a cord between the external transmitter unit and the battery unit, the external unit having an energy-transmitting inductive coil that continuously transmits energy to the energy-receiving unit.

6. The hearing aid system according to claim 1, comprising:

a fixation screw to fixate the energy-receiving unit; and a hole in the energy-receiving unit to receive the fixation screw.

7. The hearing aid system according to claim 1, wherein the vibrator supply cable has a connector so that the energy-receiving unit can be disconnected from the vibrator unit.

8. The hearing aid system according to claim 1, wherein the anchoring fixture has a threaded inner hole to receive a connection screw that attaches the mounting arm to the anchoring fixture.

9. The hearing aid system according to claim 1, further comprising:

an energy storing capacitor with a capacitance greater than 1 mF and configured to receive current from the energy-receiving unit and to build up charge from the current.

10. The hearing aid system according to claim 1, wherein the vibrator unit, the mounting arm and the anchoring fixture are one piece.

11. The hearing aid system according to claim 1, wherein the microphone system includes:

two microphones; and a programmable microphone processing circuit where the sensitivity for sound coming from a first direction and a second direction is variable by programming the circuit digitally in a programmable circuit.

12. The hearing aid system according to claim 1, including a programmable circuit for digitally programming sound processing parameters of the amplifier.

13. The hearing aid system according to claim 1, including a digital feedback suppression circuit.

14. The hearing aid system according to claim 4, further comprising:

an AM signal generator configured to generate an electromagnetic AM signal that is sent from the energy transmitting coil to the energy-receiving coil, the AM signal including sound information from the microphone and being picked up by the energy-receiving coil and rectified into a DC supply;

a vibrator driver amplifier that is supplied by the DC supply;

an AM decoder configured to convert the AM signal that is picked up by the energy-receiving coil into a decoded signal, the decoded signal passing into the vibrator driver amplifier where it is amplified to drive the vibrator.

15. The hearing aid system according to claim 4, further comprising:

a signal generator configured to generate an electromagnetic energy signal that is sent from the energy transmitting coil to the energy-receiving coil, the electromagnetic energy signal being picked up by the energy-receiving coil and rectified into a DC supply;

a vibrator driver amplifier that is supplied by the DC supply;

an FM signal generator configured to generate an electromagnetic FM signal that is transmitted from the external unit to an implanted FM receiver configured to decode the FM signal into a decoded signal, the decoded signal passing into the vibrator driver amplifier where it is amplified to drive the vibrator.

16. The direct bone conduction hearing aid system according to claim 1, wherein the housing further includes:

a curved cover attached to said wall, the curved cover having a substantially hemi-spherical cross section.

17. A method of anchoring a direct bone conduction hearing aid vibrator, comprising:

positioning an implantable vibrator unit including a housing and a vibrator attached to a wall of the housing in a mastoid cavity;

attaching an anchoring fixture into a skull bone covered by skin through a lateral skull bone surface;

anchoring the implantable vibrator unit to the skull bone with a mounting arm attached to said wall of the housing that extends in a direction substantially parallel to said wall of the housing from the implantable vibrator unit to the anchoring fixture; and positioning an implantable energy-receiving unit beside the implantable vibrator unit, the anchoring fixture and the mounting arm.

* * * * *